United States Patent [19]

Brimm

[11] 4,137,118

[45] Jan. 30, 1979

[54] CHEMICAL MILLING APPARATUS

[75] Inventor: Daniel J. Brimm, La Jolla, Calif.

[73] Assignee: Chem-tronics, Inc., Santee, Calif.

[21] Appl. No.: 837,304

[22] Filed: Sep. 27, 1977

Related U.S. Application Data

[62] Division of Ser. No. 785,168, Apr. 6, 1977.

[51] Int. Cl.[2] ..... C23F 1/02

[52] U.S. Cl. ..... 156/345; 156/639; 156/651; 156/661

[58] Field of Search ..... 156/639, 650, 651, 654, 156/659, 661, 345; 134/33, 119, 120, 121, 140, 149, 157, 159, 161

[56] References Cited

U.S. PATENT DOCUMENTS

| | | | |
|---|---|---|---|
| 2,869,266 | 1/1959 | Hirdler | 156/639 |
| 2,916,363 | 12/1959 | Doro | 156/639 X |
| 3,145,128 | 8/1964 | Sharpe | 156/345 |

*Primary Examiner*—William A. Powell

*Attorney, Agent, or Firm*—Strauch, Nolan, Neale, Nies & Kurz

[57] ABSTRACT

Chemical milling processes which employ a series of masking and metal removal steps. Apparatus for orbiting the workpiece in a prescribed manner about mutually perpendicular axes during the metal removal steps.

9 Claims, 3 Drawing Figures

CHEMICAL MILLING APPARATUS

Figure 1:
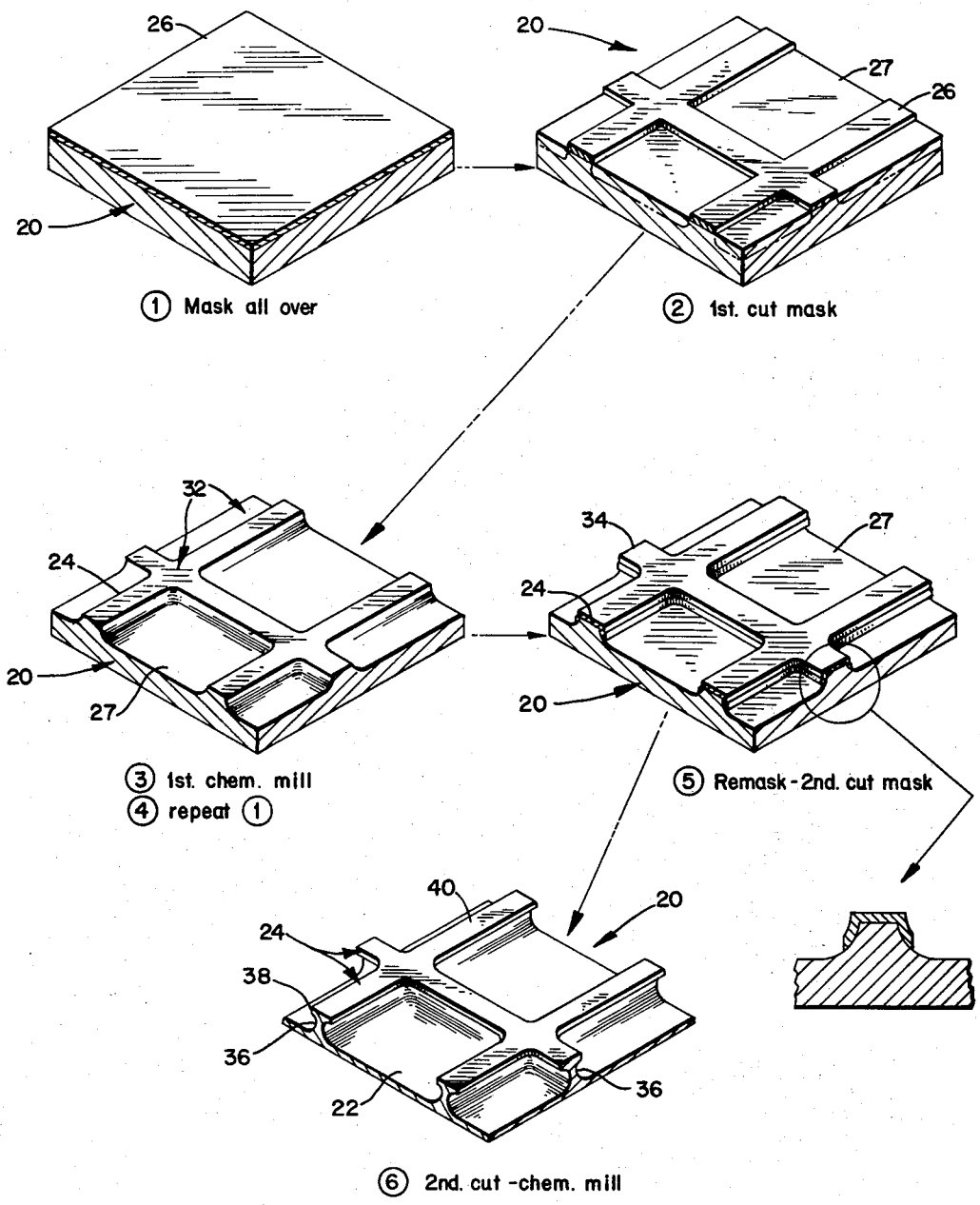

This application is a division of application Ser. No. 785,168 filed Apr. 6, 1977.

The present invention relates to the fabrication of metallic components and, more particularly, to novel improved methods and apparatus for chemically milling metallic structures.

Traditionally, skin and stringer structures and honeycomb panels have been widely used where weight is at a premium as it is in the aircraft, aerospace and related industries, for example.

In the years following World War II, however, much effort has been directed to the development and production of alternate kinds of structures having high strength-to-weight ratios but lower costs for jet engine, air frame, and other applications.

Perhaps the most efficient alternative heretofore developed is the isogrid structure, described in Slysh, The Isogrid-King of Lightweight Design, MACHINE DESIGN, Apr. 19, 1973, pp. 102–107. The isogrid technique produces a one-piece structure composed of a skin and load bearing ribs or stiffeners by machining from a solid metal plate. If the ribs are undercut to an I- or T-section to increase the strength-to-weight ratio, the resulting structures are feasible alternatives for honeycomb fabrications and skin and stringer constructions.

There are, nevertheless, a number of disadvantages to isogrid structures. The process, which usually involves numerically controlled milling and bending, is time consuming, complex, and expensive. The forming or bending step alone, for example, typically involves filling the machined out part of the workpiece with a low melting point epoxy filler, rough shaping the workpiece by manual bending, and then heat aging it in a fixture.

Furthermore, because bending follows the machining operation, the geometries that can be produced are limited. The I-section of the ribs, for example, severely limits the minimum radius to which the machined panel can be formed (Although this problem can be overcome, the solution is both technically difficult and costly). As a result, the isogrid technique is of only limited interest in applications requiring maximum efficiency coupled with low weight.

Also, special tooling is required to mill the ribs, and the inherent high strength of the I-section makes machining difficult and precludes complex, three dimensional contouring. Furthermore, it is impractical to mill the skin of the structure to less than about 0.040 inch.

I have now invented a novel technique for fabricating efficient, lightweight structures which is free of the disadvantages described above.

My process involves the steps of masking and chemically milling a metallic workpiece and then repeating this sequence of steps to further alter the workpiece configuration. For example, an efficient, lightweight structure as described above can be produced by removing metal to form the ribs and skin of the structure with the first sequence of steps and repeating the sequence to undercut and impart an I- or T-section to the ribs and reduce the thickness of the skin.

The workpiece is simultaneously rotated about mutually perpendicular axes during the milling steps, preferably at relative speeds which insure uniform removal of material by exposing every segment of the workpiece to essentially identical etching conditions.

The workpiece can be introduced into, suspended in, and removed from the milling bath and moved through the prescribed orbital path in the latter by a simple, novel, dynamic etching fixture I have invented for this purpose. The fixture includes a support for the workpiece and components for rotating the entire fixture about a horizontal axis while simultaneously revolving the workpiece and its support in the frame of the fixture about an axis which rotates in a vertical plane and therefore remains at a right angle to the horizontal axis as the fixture revolves about that axis.

It will be readily apparent to the reader from the foregoing brief description of my invention that it provides a materially superior alternative for manufacturing efficient, high strength-to-weight ratio structures.

In applications involving contoured parts the plate or other stock can be formed to shape or cast or forged forms selected, and then milled. This simplifies the contour forming step. Also, a much wider range of geometries can be produced because the limitations imposed by the already machined ribs in the bending step of the isogrid structure, for example, do not exist.

No special tooling or expensive machining equipment is required, and the chemical removal of metal makes it possible to readily produce configurations and reductions in skin thickness which cannot be obtained by mechanical machining.

Overall, my novel process is less time consuming, simpler, cheaper, and more versatile than any competing technique of which I am aware.

Yet another advantage of my invention is that there is little restriction on the metallic materials that can be fabricated by application of its technique. Among the metals that can be formed thereby are iron, nickel, titanium, niobium, aluminum, magnesium, beryllium and alloys of one or more of the foregoing.

I do not claim to have invented chemical milling per se or even the use of chemical milling to produce rib stiffened structures or parts with under cut configurations or the use of more than one chemical milling step.

U.S. Pat. No. 2,739,047 issued Mar. 20, 1956, to M. C. Sanz discloses a process in which stock is bent to shape and then chemically etched to produce a stiffened, contoured component. However, this process is only capable of producing tapered fillets having a radius of a curvature corresponding to the depth of the etch. Structures of this type are far inferior in terms of weight, stiffness, and strength-to-weight ratio to the novel I- and T-beam reinforced structures that can be produced by my novel process.

Processes employing sequential etching steps are described in U.S. Pat. Nos. 1,329,088 issued Jan. 27, 1920, to Leitner; 2,226,383 issued Dec. 24, 1940, to Norris; 2,888,335 issued May 26, 1959, to Atkins et al; and 3,737,314 issued June 5, 1973, to Ruleff et al. Again, however, the patented processes differ from mine; and there is nothing in the patents suggesting that the processes described therein could be used to make structures of the character my novel process is specifically designed to produce.

U.S. Pat. Nos. 2,887,042 issued May 19, 1959, to Broderick et al and 3,383,254 issued May 14, 1968, to Kocsuta disclose processes which, like mine, differ from conventional chemical milling techniques in that undercutting is deliberate, rather than unavoidable. Otherwise, the Broderick et al and Kocsuta processes have little in common with my invention. Undercutting is not obtained in a subsequent chemical milling step; and neither process could be used to produce anything as complex as a contoured, one-piece structure having a skin stiffened by I- or T-sectioned ribs.

I pointed out above that my invention also embodies a novel fixture which promotes rapid and uniform etching of the workpiece being processed by simultaneously rotating the workpiece in a unique manner about two mutually perpendicular axes during the chemical milling (or etching) steps. Etching apparatus capable of producing workpiece motion simultaneously about two axes has heretofore been described in U.S. Pat. Nos. 3,108,031 issued Oct. 22, 1963, to Hasala et al; 3,122,150 issued Feb. 25, 1964, to Henderson; 3,351,077 issued Nov. 7, 1967, to Hoornstra; and 3,633,594 issued Jan. 11, 1972, to Boundy.

U.S. Pat. No. 2,824,029 issued Feb. 18, 1958, to M. J. Zinty describes a method and apparatus with dual motion for washing machined parts. Rapid reciprocating motion, however, is required which is detrimental to my chemical milling process.

My novel fixture, moreover, differs from those disclosed in the foregoing patents in that the ratio of rotation of the workpiece about one axis relative to the other is such that every segment of the workpiece is exposed to essentially identical conditions without repetition except after a large number of cycles of movement.

Also, my novel etching fixture differs from those disclosed in the above-identified patents in that it can be employed to continuously or intermittently withdraw the workpiece from and lower it into the etching bath during a chemical milling step. This permits tapers and other non-uniform contours to be formed, adding still further to the variety and complexity of the configurations which can be produced by applying the principles of my invention.

Furthermore, my novel fixtures are structurally quite unlike anything disclosed in the foregoing patents.

It will be apparent to the reader from the foregoing that one primary and important object of my invention resides in the provision of novel, improved methods and apparatus for fabricating metallic structures.

Another primary and important object of my invention resides in the provision of novel, improved chemical milling processes.

Still other important but more specific objects of my invention reside in the provision of processes in accord with the preceding object:

- which can be used to more economically produce efficient, lightweight structures than competing processes;
- which are more versatile than and can be employed to fabricate structures that it is impractical or impossible to fabricate by heretofore available processes;
- which employ a repeated sequence of masking and etching or chemical milling steps that makes it possible to produce I-, T-, and comparable sections, and, if wanted, other contours and various combinations thereof in a single structure;
- which make it possible to produce structures with tapered and other non-uniform configurations;
- which can be used to form a wide variety of metallic materials.

Still other important, specific objects of my invention reside in the provision of novel apparatus for carrying out processes as described in the preceding objects:

- which produces cyclic motion of the workpiece in the chemical milling solution and insures that the workpiece will return to a specific orientation in the solution only after a large number of cycles, thereby promoting uniform and efficient removal of metal from the workpiece;
- which permits the workpiece to be continuously or intermittently withdrawn from the etching solution during a chemically milling step to produce tapered or other non-uniform contours.

Other important objects and features and additional advantages of my invention will be apparent from the foregoing general description of my invention, from the appended claims, and from the ensuing detailed description of the invention as it proceeds in conjunction with the accompanying drawing, in which:

FIG. 1 illustrated pictorially the steps involved in forming a workpiece to shape in accord with the principles of the present invention.

Figure 2:
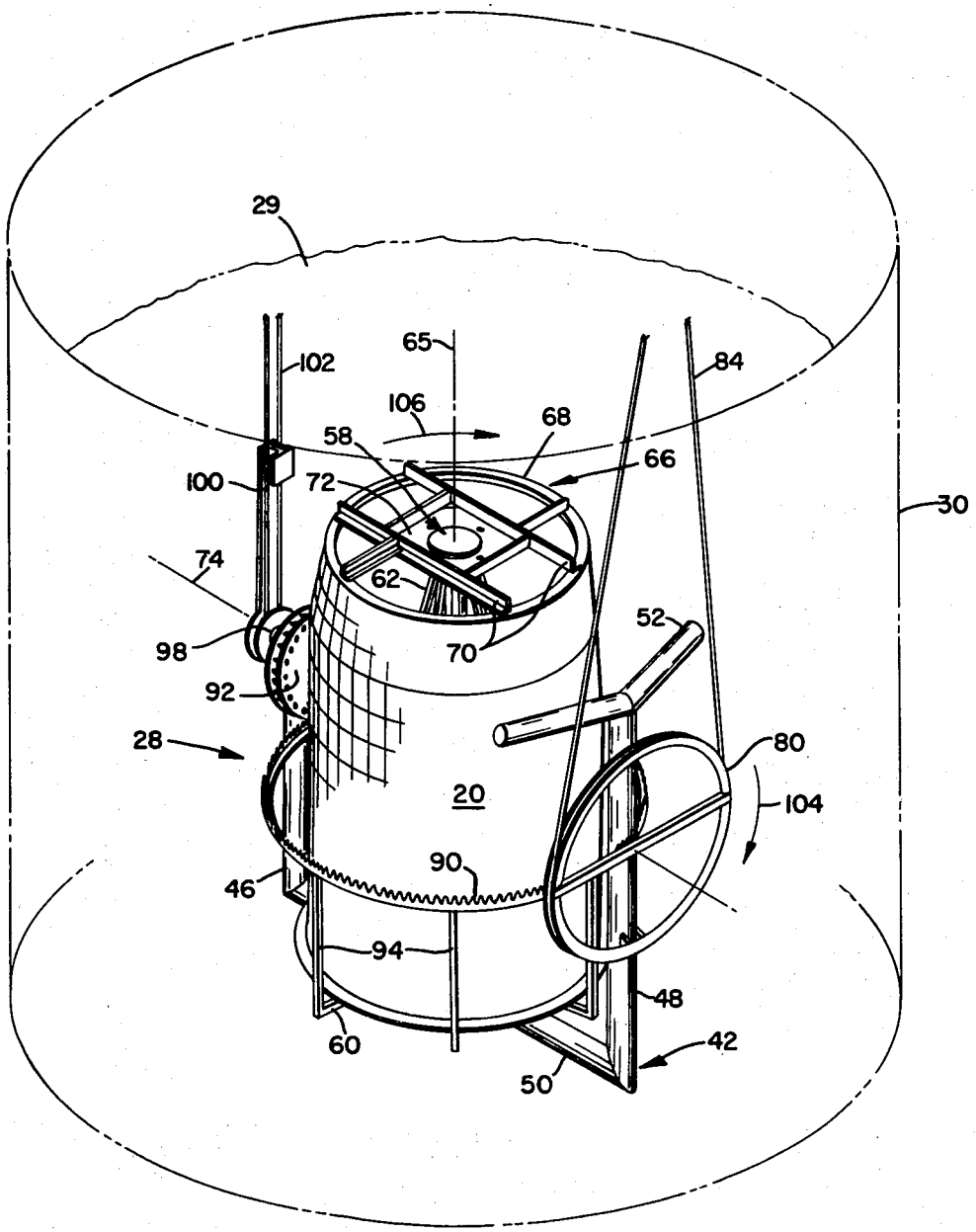
Figure 3:
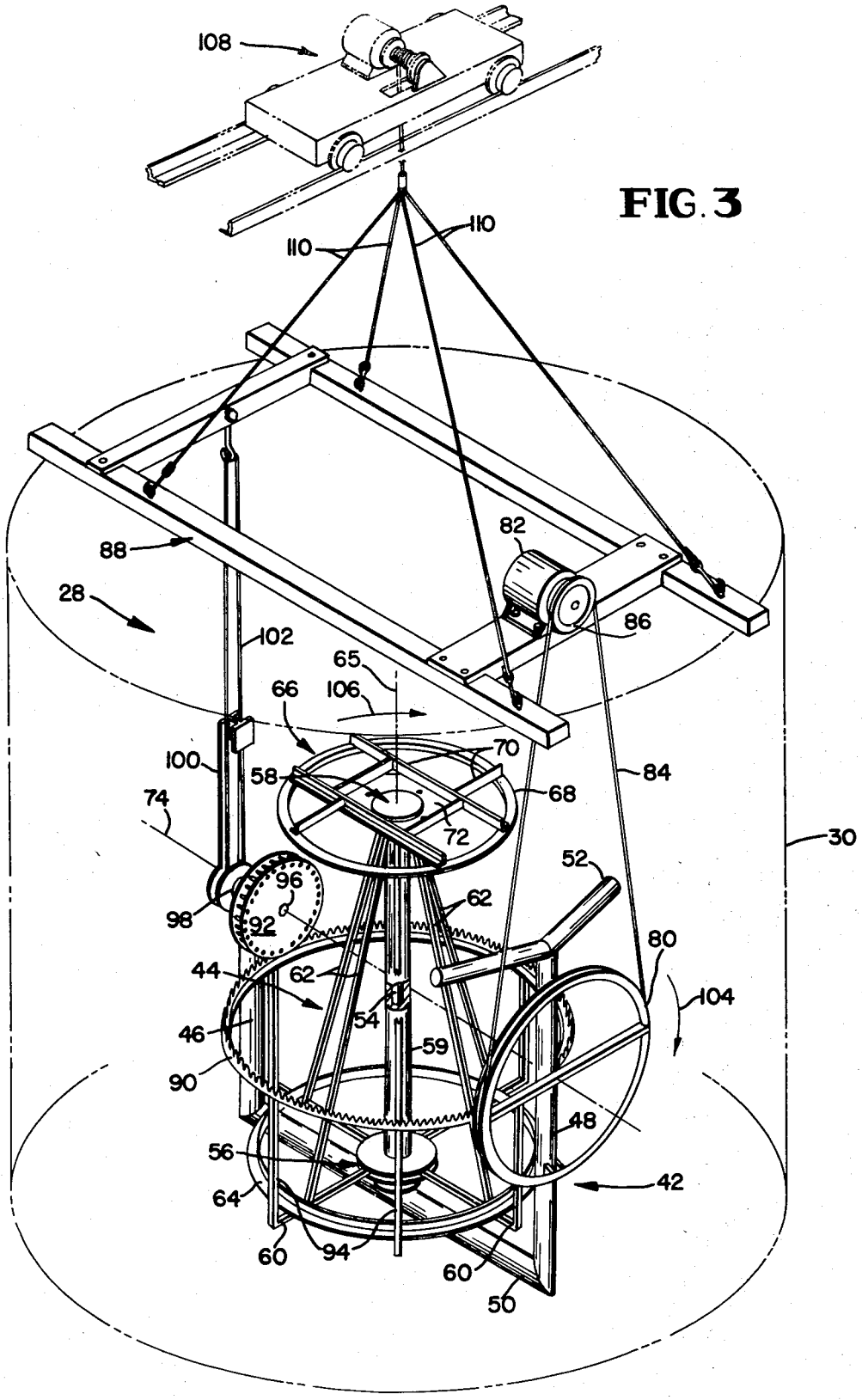

FIG. 2 is a pictorial view of a barrel-shaped workpiece supported in a fixture constructed in accord with the principles of the present invention and designed to simultaneously orbit the workpiece about two mutually perpendicular axes during the etching or metal removal steps of the process shown diagrammatically in FIG. 1; and FIG. 3 is a pictorial view of the fixture showing in detail its construction and components.

Referring now to the drawing, FIG. 1 depicts diagramatically the steps involved in shaping a structure in accord with the principles of the present invention. The structure may be, for example, a contoured structure or workpiece such as the barrel-shaped jet engine compressor housing 20 shown in FIG. 2.

To make a component as shown in FIG. 2, a blank of sheet or plate stock of a selected composition is contoured by forming or bending and then joining the edges of the blank together to form a barrel-shaped workpiece. As techniques for bending and joining metallic materials are well-known and as the initial forming steps are not part of the present invention, those steps will not be described further herein.

The objective of the present invention shown diagramatically in FIG. 1 is to reduce the uniformly sectioned structure just described to one which, as best shown at "6" FIG. 1, has a thin skin 22 reinforced by I-sectioned, integral ribs or stiffeners 24.

The first step in the process is to completely mask structure 20. Masking with photoresists or other techniques which can be employed is again not part of the present invention since materials are commercially available and methods are well known. For purposes of illustration the workpiece is coated with a suitable vinyl maskant. As vinyl and other masking materials are commercially available and described in U.S. Pat. No. 3,380,863 issued Apr. 30, 1968, to Silberberg and elsewhere in the literature, I do not deem it necessary to describe the masking material herein in detail. Nor do I consider it necessary to describe how the masking material is applied as brushing, spraying, and dipping techniques for such materials are well known.

The next step in my novel process is to strip the mask 26 from those areas 27 of component 20 where metal is to be removed. At the end of this step the structure will appear as shown at "2" in FIG. 1.

Next, component 20 is installed in the etch fixture 28 shown in FIG. 2 and immersed in a bath 29 of etching solution contained in a conventional vat or tank 30 (see FIG. 3). The composition of the etching solution is not part of my invention. Suitable compositions are described in, for example, U.S. Pat. Nos. 3,039,909 issued June 19, 1962, to De Long et al; 3,061,494 issued Oct. 30, 1962, to Snyder et al; 3,108,919 issued Oct. 29, 1963, to Bowman et al; 3,134,702 issued May 26, 1964, to De Long et al, and 3,745,079 issued July 10, 1973, to Cowles et al.

The parameters involved in the etching step such as concentration of active agent, temperature, etching rate, etc., will vary from application-to-application of my invention. Because of this and because the literature is replete with information from which these parameters can be readily determined for any specific application (see for example, METALS HANDBOOK (8th Ed.), American Society for Metals, Metals Park, Ohio, 1967, Vol. III, pp. 240–249) they, likewise, will not be discussed herein.

At the end of the etching step, fixture 28 and structure 20 are withdrawn from the etching solution and the mask 26 stripped away. Optionally, before stripping away the mask, the workpiece may be washed to remove the last vestiges of the active etching agent and/or pickled or surface treated, for example. Again, these are techniques well known in the chemical milling art.

After mask 26 is stripped away, workpiece 20 will have the configuration shown at "3" in FIG. 1. The exposed areas 27 have been reduced approximately 50 percent in thickness, leaving ribs 24 in the areas protected by mask 26. At this stage in my process ribs 24 have the configuration shown in the above-cited Sanz patent. Therefore the structure has a substantially less than optimum strength-to-weight ratio. This ratio is materially increased by further metal removal in accord with the principles of the present invention.

The next step in my process is to remask the outer surface 32 of workpiece 20. The same masking material and application technique employed in the first masking step may be used.

Next, the second mask 34 is stripped away from those areas of the structure where the removal of additional metal is wanted.

For example, in the exemplary application of my invention shown in FIG. 1, the masking material is stripped from the areas generally coincidental with the original, exposed areas 27 so that the thickness of the original stock in these areas will be further reduced to form skin 22. Also, the masking material is stripped from those parts of the ribs or stiffeners 24 which will become the webs 36 of the stiffeners, leaving only what will be the flanges 38 and outer surfaces 40 of the stiffeners covered and protected from chemical attack.

After mask 34 is selectively stripped away as just described, the workpiece is again assembled in fixture 28 and immersed in an etching solution which may be identical to that used in the first etching step. At the end of this step, the fixture and component are withdrawn from the etching solution; and mask 34 is stripped from the workpiece, optionally first washing and/or otherwise treating the workpiece as described above.

The stripping away of mask 34 completes the process, leaving structure 20 with the skin and integral, I-sectioned stiffener configuration shown at "6" in FIG. 1.

The chemical milling of complex configurations such as those with I-sectioned ribs or stiffeners as shown at "6" in FIG. 1, which I can readily accomplish, has heretofore been completely impractical.

In particular, chemical milling involves the evolution of gases and the formation of bubbles on the surface of the workpiece being etched. These bubbles tend to rise vertically to the surface of the etching solution. Consequently, the bubbles tend to run along vertical surfaces of the component being etched, isolating such surfaces from the etching liquid.

Also, as I- and other configurations with overhangs are formed, bubbles can become trapped on the workpiece, again isolating the workpiece from the etching solution.

The result of the foregoing is undesirable variations in the etching process and a consequent lack of uniformity in the final structure.

The undesirable effects of gas evolution in the etching steps is minimized, if not entirely eliminated, by the novel dynamic etching fixture 28 illustrated in FIGS. 2 and 3. This fixture keeps the workpiece in constant motion about two, mutually perpendicular axes in the etching solution with the rates of rotation about the two axes being so related that the workpiece will return to its original position only after many cycles of motion. These rates of rotation are kept slow enough to avoid unwanted fluid flow patterns on the workpiece and the non-uniform etching that would produce, but rapid enough to allow evolved gases to flow directly to the surface of the etching solution, thereby avoiding gas flow patterns and trapped bubbles.

In the exemplary application of my invention shown in FIGS. 2 and 3, one of the two axes about which the workpiece rotates is horizontal and the second axis rotates about the horizontal axis in a vertical plane. In this particular fixture, rates of rotation about the horizontal axis of 0.1 to about 4 revolutions per minute are employed with the specific speed depending upon the size of the part being etched.

The workpiece is rotated somewhat more slowly about the axis lying in the vertical plane. for example, I have found that a ratio of 3.0566 to 1 between the rates of revolution about the horizontal axis and the axis lying in the vertical plane are satisfactory for the particular fixture shown in FIGS. 2 and 3. This ratio produces the wanted, slower rotation about the latter axis and ensures that every segment of the workpiece is exposed to essentially identical conditions without repetition except after a large number of cycles of movement.

Other ratios may of course be employed. For example, I have used ratios between 2 to 1 and 50 to 1. The lower ratios, however, result in uneven etching because repetition occurs after a small number of cycles. Decimal ratios are preferred because repetition occurs only after many cycles. A ratio of 3.0556 to 1, for example, provides over 50 non-repetitive cycles before elements repeat a given path.

Turning now to FIGS. 2 and 3, the major components of fixture 28 include a U-shaped support frame 42 and a workpiece retainer 44.

Frame 42 has two parallel legs 46 and 48. At one end of the frame legs 46 and 48 join a transversely extending cross member 50.

A counterweight 52 is attached to the opposite end of leg 48 to balance the fixture and a workpiece secured therein as the fixture and workpiece are rotated.

Workpiece retainer 44 is journalled by polyvinyl chloride or other etch solution resistant bushings (not shown) on an axle 54. The axle is mounted on the cross member 50 of frame 42 and extends therefrom parallel to and in the same direction as legs 46 and 48 of the frame.

Part retainer 44 includes lower and upper mounts 56 and 58 at opposite ends of a tubular member 59 surrounding axle 54. The inner ends of radially extending structural members 60 are fixed to lower mount 56. Vertically inclined support members 62 are fixed to and extend between the radial supports 60 and upper mount 58.

The radially extending structural members 60 also support workpiece 20 (see FIG. 2). A locating ring 64 mounted on members 60 positively positions the workpiece in directions normal to the axis of rotation 65 of axle 54.

The workpiece is clamped against support members 60 with the workpiece axis of symmetry coincident with axis 65 by a removable retaining ring 66 which has a rim 68 dimensioned to engage the upper end of the workpiece (see FIG. 2). Rim 68 is fixed by structural members 70 to a centrally located support 72 which is apertured to fit on the upper part of mount 58. Member 72 of the retaining ring is seated on and adapted to be bolted or otherwise removably secured to a retaining ring support flange (not shown) on upper workpiece retainer mount 58 immediately subjacent that part of the mount protruding through retaining ring central support 72.

During the etching steps of my novel process, fixture 28 simultaneously rotates component 20 about horizontal axis 74 and about the longitudinal axis 65 of axle 54.

Fixture 28 and workpiece 20 are supported at one side of the fixture and rotated about horizontal axis 74 in etching solution 29 by a pulley 80 fixed to leg 48 of support frame 42 for rotation therewith. Pulley 80 is turned by a preferably variable speed motor 82 and an endless drive member 84 trained around pulley 80 and motor drive pulley 86.

Motor 82 is mounted on a fixture support 88 which rests on the lip of tank 30 during the etching steps. The construction of this support is not critical and will therefore not be described herein.

The rotation of the fixture and component 20 about axis 74 also effects rotation of part retainer 44 and component 20 about the axis 65 perpendicular thereto by way of a rotating gear 90 and a fixed gear 92 meshed with gear 90.

Gear 90 is fixed to part retainer 44 for rotation therewith about axis 65 by structural members 94 extending between the gear and radially oriented structural members 60.

Fixed gear 92 is non-rotatably fixed to an axle 96. The axle is rotatably journalled in a fitting 98 at the end of support frame leg 46 opposite cross member 50 in alignment with axis 74. Fixture 28 and workpiece 20 are consequently rotatable about and supported by the axle at the side of the fixture opposite pulley 80.

The end of axle 96 opposite gear 92 is non-rotatably attached to a fixture support arm 100. Arm 100 is supported in a vertical, non-rotatable orientation by a lifting cable 102 extending from the support arm to that end of fixture support 88 opposite motor 82. This keeps axle 96 and gear 92 from rotating.

As the support frame and component 20 rotate about axis 74 in the direction indicated by arrow 104 in FIGS. 2 and 3, fixed gear 92 drives rotatable gear 90 and, therefore, part retainer 44 and workpiece 20 about axis 65 in the direction indicated by arrow 106. The decimal fraction gear ratio of gears 90 and 92 such as the exemplary 3.0556:1 ratio discussed above ensures that the workpiece will return to any given position only after a large number of cycles of motion.

Fixture 28 and workpiece 20 and immersed in and removed from tank 30 by a conventional two-rail hoist 108 connected to fixture support 88 as indicated by reference character 110 in FIG. 3. Other hoisting arrangements may of course equally well be employed.

Hoist 108 can also be employed to cyclically or intermittently raise and lower fixture 28 and workpiece 20 during the course of the etching step. This technique is used to form tapered or other non-uniform configurations on the workpiece.

Still other variations and configurations may be produced by stripping parts of mask 26 or mask 34 (or both) from the workpiece at one or more times before the associated etching step is completed and then returning the workpiece to the etching solution. Parts of the workpiece exposed later in the etching cycle will, as a result, not be etched to as great a depth as those exposed earlier.

Yet other variations and increasingly complex configurations can be obtained by increasing the number of masking/etching sequences beyond the two used in the above described exemplary application of the principles of my invention.

Also, by appropriately stripping away selected parts of mask 34, combinations of ribs as shown at "3" in FIG. 1 and I-shaped stiffeners as shown at "6" can readily be produced. Lands, bosses, and the like can be similarly provided.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed and desired to be secured by Letters Patent is:

1. Apparatus for supporting a workpiece and effecting a selected pattern of motion of the workpiece in a chemical milling bath, said apparatus comprising: a supporting frame; means for rotating said frame about a first axis; an axle mounted on said frame with its longitudinal axis at right angles to said first axis; a workpiece retainer journalled on said axle for rotation about said axle relative to said frame and for rotation about said first axis concomitantly with said frame; and means for rotating said workpiece retainer about said axle as said frame and retainer are rotated about said first axis comprising a first gear rotatable with the workpiece retainer and a second gear meshed with said first gear, said second gear being non-rotatably fixed relative to said supporting frame, whereby a workpiece supported by said workpiece retainer can be simultaneously rotated about said first axis and the longitudinal axis of the axle on which said retainer is mounted.

2. Apparatus as defined in claim 1 wherein the means for rotating the supporting frame and workpiece retainer about said first axis comprises a pulley fixed to said supporting frame and a flexible drive member trained around said pulley.

3. Apparatus as defined in claim 1 wherein said supporting frame has two generally parallel legs and a cross member extending between opposite ends of said legs, said axle being mounted on said cross member and extending in the same direction therefrom as said legs.

4. Apparatus as defined in claim 3 together with a counterweight at the end of one of said legs opposite the cross member to balance the weight of the axle and workpiece retainer and the workpiece supported from said retainer.

5. Apparatus as defined in claim 1 together with lifting means for raising and lowering said frame and the workpiece retainer to thereby lift from and lower into the chemical milling bath the workpiece supported by said retainer and means providing a rotary connection between said supporting frame and said lifting means.

6. Apparatus as defined in claim 1 wherein said first gear is fixed to the workpiece retainer and is adapted to surround the workpiece supported by said retainer.

7. Apparatus for supporting a workpiece and effecting a selected pattern of motion of the workpiece in a chemical milling bath, said apparatus comprising: a supporting frame; means for rotating said frame about a first axis; a workpiece retainer; means rotatably supporting said workpiece retainer for rotation about a second axis oriented at right angles to said first axis; and means for rotating said workpiece retainer about said second axis as said frame is rotating about said first axis at a rate which is in the ratio of 2:1 to 50:1.

8. Apparatus as defined in claim 7 in which the means for effecting rotation of said workpiece about said second axis comprises a non-rotatable first gear having its longitudinal axis aligned with the first axis about which the supporting frame rotates and a second gear which is meshed with said first gear and is rotatable with said retainer about said second axis and about said first gear around said first axis.

9. Apparatus as defined in claim 7 wherein said supporting frame has two generally parallel legs and a cross member therebetween at one end of said frame and wherein said apparatus further includes a lifting member and an axle fixed to and extending horizontally therefrom, said first gear being fixed to said axle and that end of the one of said supporting frame legs opposite the cross member being journalled on said axle for rotation thereabout.

* * * * *